US007009122B2

(12) United States Patent
Pearson et al.

(10) Patent No.: US 7,009,122 B2
(45) Date of Patent: Mar. 7, 2006

(54) PUSH-TO-START APPLIANCE PROGRAM TIMER AND METHOD UTILIZING SNAP-ACTION SWITCH

(75) Inventors: James E. Pearson, Downers Grove, IL (US); Jack D. Rodesiler, West Chicago, IL (US)

(73) Assignee: Robertshaw Controls Company, Richmond, VA (US)

( * ) Notice: Subject to any disclaimer, the term of this patent is extended or adjusted under 35 U.S.C. 154(b) by 568 days.

(21) Appl. No.: 10/265,915

(22) Filed: Oct. 7, 2002

(65) Prior Publication Data

US 2004/0066096 A1 Apr. 8, 2004

(51) Int. Cl.
*H01H 43/00* (2006.01)

(52) U.S. Cl. ..... 200/38 R; 200/38 B

(58) Field of Classification Search ..... 200/33 R, 200/35 R, 36 R, 38 R–38 DC
See application file for complete search history.

(56) References Cited

U.S. PATENT DOCUMENTS 3,371,170 A * 2/1968 Thomas et al. ..... 200/38 B
3,582,582 A * 6/1971 Pauker et al. ..... 200/38 B
3,973,135 A 8/1976 Scott
3,988,727 A 10/1976 Scott
4,062,007 A 12/1977 Scott
4,146,760 A 3/1979 Voland
4,210,824 A * 7/1980 Marquis et al. ..... 307/141
4,412,110 A * 10/1983 Wojtanek ..... 200/38 R
4,796,484 A * 1/1989 Eder ..... 74/568 T
5,030,801 A * 7/1991 Amonett ..... 200/38 R
5,170,022 A * 12/1992 Bouron ..... 200/38 R
6,274,827 B1 * 8/2001 Loffler ..... 200/38 D

OTHER PUBLICATIONS

Bestbuy.com, "Amana Gas Dryer" http://www.bestbuy.com/detail.asp?e_11074365&m=1596&cat=1600&scat=1602 (last visited Aug. 16, 2002).

* cited by examiner

*Primary Examiner*—Michael A. Friedhofer
(74) *Attorney, Agent, or Firm*—Reinhart Boerner Van Deuren

(57) ABSTRACT

A program timer for use with commercial or consumer appliances provides a single user knob interface that allows the desired selection of a programmed cycle and a push-to-start function. To preclude inadvertent program operation and enhance the life of the program timer, a snap-action switch is utilized to provide the push-to-start functionality. As such, actuation of the start switch provides a positional hysteresis that prevents teasing of the switch. The rapid snap-action opening and closing of the switch contacts precludes or minimizes the arc sustained between the contacts so as to greatly increase the life of the start switch. In one embodiment an actuation wheel larger in diameter than the program cam stack of the timer is utilized to pivot a lever to actuate the snap-action switch.

21 Claims, 7 Drawing Sheets

PUSH-TO-START APPLIANCE PROGRAM TIMER AND METHOD UTILIZING SNAP-ACTION SWITCH

FIELD OF THE INVENTION

The present invention relates generally to appliance timer controls, and more particularly to timer control mechanisms and methods providing both timed program operation and start switch functionality.

BACKGROUND OF THE INVENTION

Consumer and commercial appliances, such as for example clothes dryers, typically include some form of program timer that allows the user to select a desired operating cycle. In typical appliances, these program timers are embodied in a motor driven cam stack having a number of control switches that are operated via followers. These followers track one of the control faces on the cam stack. The selection of the particular program cycle is typically made via a rotary switch that is rotated to a particular position based on the graphics on the control panel of the appliance. This mechanical interface to the program timer control is familiar to consumers and provides a very simple user interface. Indeed, such a mechanical knob interface is still used in many electronic controllers that utilize a microprocessor to control the various operating cycles as opposed to the rotating cam stack.

Once the appropriate or desired program cycle is selected by the user, the appliance is started via actuation of a momentary contact switch. Typically, this start switch is a push button switch. Actuation of this momentary contact push button start switch energizes the start windings of the appliance's main motor. Once the motor begins to rotate, a centrifugal switch in the main motor actuates to maintain its energization. The user is then free to release the momentary contact push button start switch.

In one type of conventional appliance, the momentary contact push button start switch is integrated into the program cam stack controller. In such a configuration, the program selector knob is depressed to start the main motor of the appliance. That is, in this type of conventional appliance, the program selector knob is rotated to select a desired program cycle, and is then depressed momentarily to start the selected program cycle.

Unfortunately, such a program timer with an integrated push button start switch is subject to misoperation by the user, resulting in shortened switch life and erroneous program operation. That is, because the momentary contact push button switch is integrated into the rotary control knob of the program timer, a user may inadvertently push in the knob while turning the knob to select a desired program cycle. If the knob is depressed far enough while rotating the knob to select a desired program cycle, the momentary contact push button switch may intermittently make contact. This energizes or attempts to energize the start winding of the appliance motor. This intermittent operation may damage the appliance motor, and may result in intermittent arcing between the switch contacts as they are intermittently connected and disconnected during the rotation of the switch. This arcing may damage and thus shorten the switch life itself.

Even if the momentary contact push button switch is not actuated intermittently during rotation of the program timer control knob, the speed and consistency at which the user presses the control knob to start the appliance may still result in intermittent or otherwise inappropriate contact of the momentary contact push button switch. That is, if the user were to slowly depress the rotary knob the contacts may intermittently make and break contact numerous times before a firm contact is made. This will result in excessive arcing between the switch contacts and will shorten the life of the switch. Likewise, if the user were to withdraw the knob slowly once the appliance had been started, the slow separation of the electrical contacts of the momentary contact push button switch will draw and sustain an electrical arc. This will also serve to damage and thus shorten the life of the program timer.

Recognizing the deficiency with the integrated program controller and start switch, many manufacturers employ an appliance control panel that separates the program timer control selection knob from the start switch. In such appliances, the user first selects the desired program cycle with the rotary program cycle select switch. Once the appropriate cycle has been selected, the user presses a separate momentary contact start switch located on the appliance's control panel. Unfortunately, while separating these two functions eliminates the intermittent starting of the appliance while the user is selecting a desired program cycle, the separate start switch is still subject to damage based on the manner in which the user depresses and releases the switch. That is, the arcing problem described above resulting in shortened life of the switch is still prevalent as the user may slowly depress or slowly release the separate start switch in a manner that results in arcing.

There exists, therefore, a need in the art for a program timer that can perform the appliance start function without the intermittent arcing problems currently existing in the art.

BRIEF SUMMARY OF THE INVENTION

In view of the above, the present invention is directed to a new and improved program timer and method that overcome the above-described and other problems existing in the art. More specifically, the present invention is directed to a program timer and method that, in addition to program cycle timing functionality, also provide appliance start functionality without the adherent problems discussed above.

In one embodiment of the present invention the appliance start functionality is provided by a snap-action electrical switch that is actuated by the user depressing the rotary program timer knob. This knob is attached to the shaft of the program timer, which in one embodiment includes a switch activation wheel affixed thereto. This switch activation wheel is preferably larger in diameter than the cams of the cam stack. Upon depression of the knob by the user, the shaft and its associated wheel move a lever pivotally positioned in relation thereto to activate the snap-action switch to close the switch contacts. Preferably, the shaft is spring biased to its outward position such that upon release of the knob by the user, the shaft will be returned to its quiescent outward position. As the shaft and its associated wheel are returned to their quiescent position, the snap-action switch is allowed to operate to open the switch contacts.

The extremely rapid action of the snap-action switch prevents the teasing of the switch contacts between the open and closed states. This prevents or minimizes an intermittent contact or sustained arc condition that could otherwise shorten the life of the switch. Further, the snap-action switch provides positional hysteresis to prevent or minimize any inadvertent, intermittent operation of the start functionality while the user is rotating the program selector knob to select the desired operating cycle of the appliance. That is, once the user has depressed the rotary knob a distance sufficient to actuate the snap-action switch, the knob must be released a significant distance, near its quiescent position, before the snap-action switch will operate to open the contacts. Further, the stored energy that results in the snap-action to both open and close the contacts results in a very rapid transition between the open and closed state such that arcing and localized high current flows at only a portion of the contact surface area is greatly minimized.

In a preferred embodiment of the present invention, a push-to-start appliance program timer for use with an appliance comprises a housing, a program cam stack defining at least one program cycle, and a number of switches responsive to the program cycle to control operation of the appliance during the program cycle. The timer also includes a shaft in rotary driving engagement with the cam stack. This shaft is linearly translatable within the housing along an axis of the shaft through the cam stack. In this embodiment the shaft further includes an actuation wheel integrated with it. The timer further includes a snap-action start switch and an actuation lever positioned within the housing to translate linear movement of the shaft to actuate the snap-action switch. Preferably, the shaft includes a user interface knob operably coupled on one end external to the housing to rotate the shaft and the cam stack to select a program cycle. In this embodiment the wheel is operable to translate linear motion of the shaft to the lever at any rotary position of the knob.

In one embodiment the wheel has an outer diameter larger than an outer diameter of the cam stack. The snap-action start switch preferably includes an actuation surface and a push button. The actuation lever translates the linear movement of the shaft to a normal direction by sliding along this actuation surface to actuate the push button. Preferably, the timer further comprises a bias means for returning the shaft to a quiescent position within the housing. In one embodiment the bias means comprises a spring positioned about the shaft to return the shaft to its quiescent position.

The snap-action start switch in one embodiment includes an outwardly biased push button operably coupled through an actuation surface to the actuation lever. The snap-actuation start switch actuates to close its electrical contacts upon linear translation of the shaft to a first position. The snap-actuation start switch actuates to open its electrical contacts upon linear translation of the shaft to a second position. Preferably, the first position and the second position are not equal. In one embodiment, the first position and the second position are selected to provide positional hysteresis for actuation of the snap-action start switch. Preferably, the first position is selected to be proximate to a maximum linear translation of the shaft, and the second position is selected to be proximate to a quiescent position of the shaft. In one embodiment, the program control mechanism is a motor driven cam stack having a plurality of program cycles programmed thereon. This mechanism also includes a number of switches operating in response to the program cycles to control operation of the appliance. The program control mechanism may also be an electronic controller having the mechanical shaft user interface. Such controller may be microprocessor based.

In an alternate embodiment of the present invention, an appliance program timer comprises a shaft configured to accommodate a user interface knob affixed on one of its ends, a program control mechanism responsive to a rotary position of the shaft to control operation of an appliance, and a snap-action start switch responsive to a linear translation of the shaft to a first position to close its electrical contacts to begin a selected program cycle and to a second position to open its electrical contacts. Preferably, the first position and the second position are selected to provide linear positional hysteresis for the actuation of the snap-action start switch.

Preferably, the timer further comprises an activation lever pivotably positioned to translate linear motion in the shaft in a first direction to linear motion in a normal direction to activate the snap-action start switch. In one embodiment the shaft includes an actuation wheel integrated with it. In this embodiment linear motion in the shaft is translated to the activation lever by the activation wheel regardless of a rotary position of the shaft. Preferably, the timer further includes a bias means for linearly biasing the shaft to a quiescent linear position. In one embodiment, the bias means is a compression spring. The shaft of this embodiment of the invention is linearly translatable between the quiescent linear position and an inward depressed position. The first position is selected to be closer to the inward depressed position than the quiescent linear position, and the second position is selected to be closer to the quiescent linear position than the inward depressed position. In another embodiment wherein the shaft is linearly translatable between the quiescent linear position and an inward depressed position, the first position is selected to be proximate to the inward depressed position, and the second position is selected to be proximate to the quiescent linear position.

In a further embodiment of the present invention, a method of providing a push-to-start function in an appliance program timer having a shaft that is rotatable to select a desired program cycle and linearly translatable from an outward biased position to an inward depressed position to start the program cycle is presented. This method comprises the steps of providing a snap-action start switch, actuating the snap-action start switch to close its electrical contacts upon linear translation of the shaft to a first position, and actuating the snap-action start switch to open its electric contacts upon linear translation of the shaft to a second position.

Preferably, the step of actuating the snap-action start switch to close its electrical contacts upon linear translation of the shaft to the first position comprises the step of actuating the snap-action start switch to close its electrical contacts upon linear translation of the shaft to a first position proximate the inward depressed position. Also preferably, the step of actuating the snap-action start switch to open its electrical contacts upon linear translation of the shaft to the second position comprises the step of actuating the snap-action start switch to open its electrical contacts upon linear translation of the shaft to a second position proximate the outward biased position.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
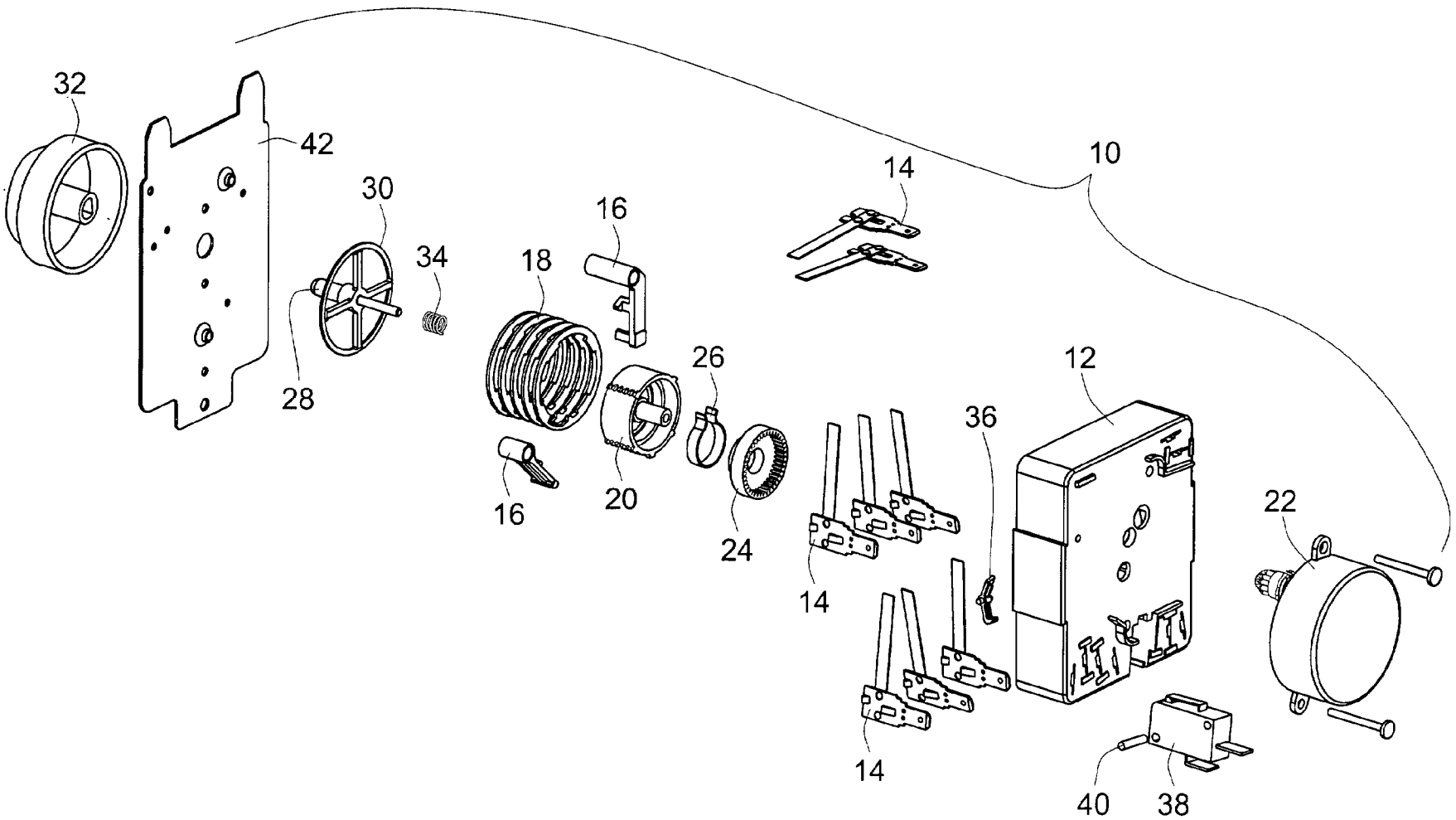
FIG. 1 is an exploded isometric illustration of one embodiment of the program timer of the present invention.

An exemplary embodiment of the push-to-start program timer 10 of the present invention is illustrated in exploded isometric form in FIG. 1. In such an exemplary embodiment having particular applicability to a consumer or commercial appliance such as a dryer, the assembly includes a housing 12 to accommodate the various sub-assemblies that perform the timing and switching functions of the appliance. The various switch assemblies 14 are accommodated within the housing 12 and are actuated by actuators 16 in accordance with the operational program contained on the individual control cams of the cam stack 18.

As is typical with a cam stack based program timer, the programmed cam stack 18 is carried on a cam hub 20. The cam hub 20 is rotated by motor 22, which drivingly engages the cam hub through the drive hub 24 and a clutch spring 26. Alternatively, the user may also rotate the cam hub 20 via the user knob 32 which is coupled to the program timer user shaft 28. As the user rotates the shaft 28 (via the user knob 32), the clutch spring 26 allows the cam hub 20 to rotate without rotating the drive shaft of the motor 22 through the drive hub 24. In this way the user may easily and quickly rotate the knob to select the desired program cycle. Once the cycle has been selected, operation of motor 22 will drive the cam stack 18 to properly sequence the switch assemblies 14 (via actuators 16) to perform the functionality during the selected cycle.

In accordance with this embodiment of the present invention, the shaft 28 includes therewith or attached thereto an actuation wheel 30. Preferably, this actuation wheel 30 is of a diameter larger than the diameter of the cams of the cam stack 18, the reason for which will be discussed more fully below. In this embodiment, the shaft 28 may be linearly translated from a quiescent position to an actuated position by a user who pushes on the knob 32. Upon release of the knob 32, a return spring 34 translates the shaft 28 back to its quiescent position. Of course, if a pull-to-start function is desired instead of a push-to-start function, this operation would be reversed. However, in the current embodiment, linear actuation of the shaft 28 also linearly translates the wheel 30, which then actuates the start switch lever 36. As will be discussed more fully below, actuation of the start switch lever 36 results in actuation of the snap-action start switch 38, which is held in place within the housing 12 by a start switch support pin 40. A cover 42 may be included to close the assembly 10, as desired.

Figure 2:
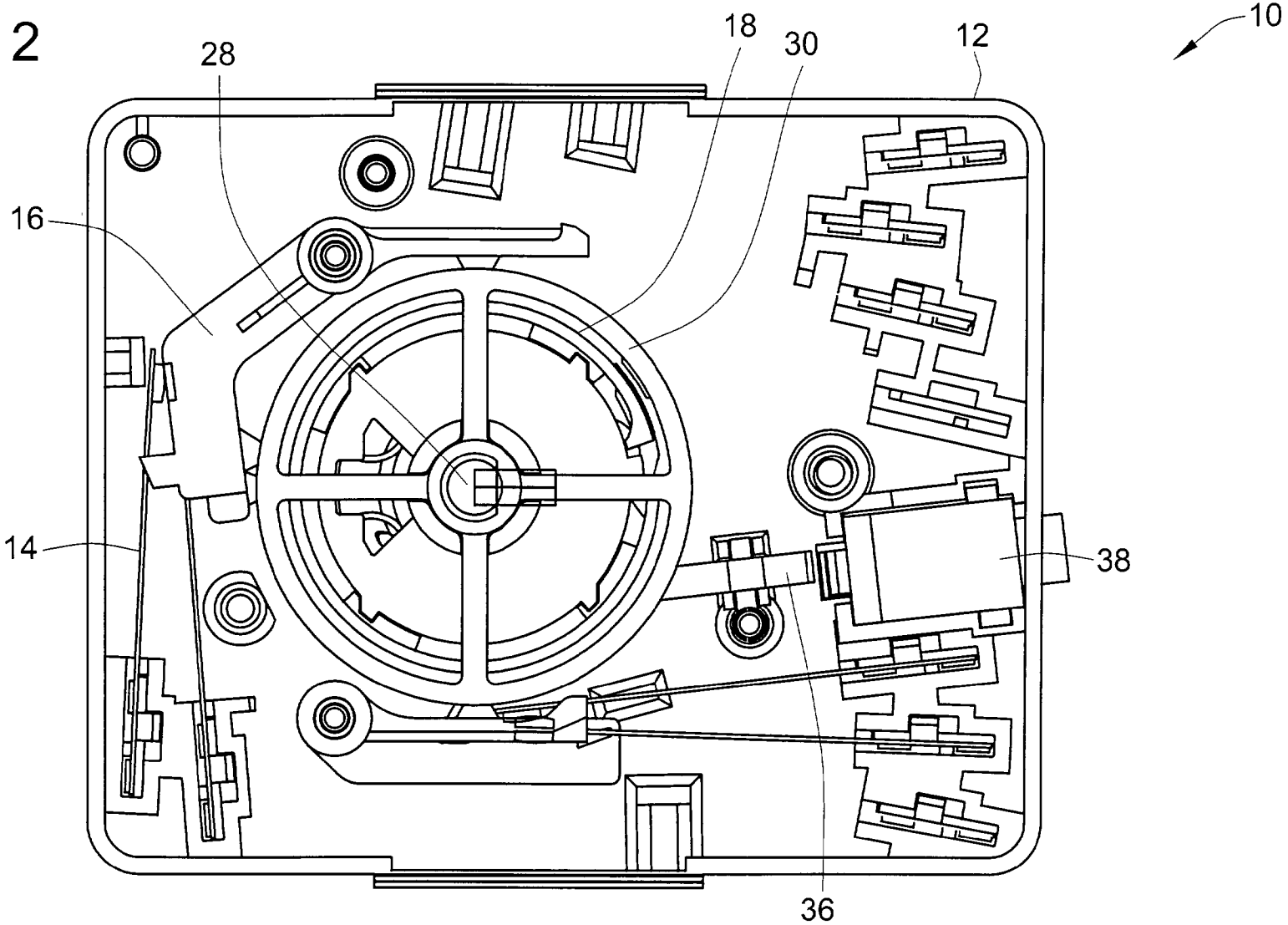
FIG. 2 is a simplified top view illustration of the embodiment to the present invention illustrated in FIG. 1 illustrating relative positioning of the components thereof.

The relationship between the various components of the assembly 10 may be better understood from the simplified top view illustration of FIG. 2. It will be understood by those skilled in the art that this FIG. 2 is a simplified illustration having some components removed from the housing 12. This simplified top view illustration shows the relationship between the larger diameter actuation wheel 30 as compared to the individual cams of cam stack 18. In this way, the snap switch actuation lever 36 may be pivotally positioned within housing 12 so that linear actuation of the wheel 30 will allow it to act on lever 36 without interfering with the outer control surfaces of the cam stack 18. As the lever 36 is pivoted by the linear actuation of wheel 30, it acts on the actuation mechanism of the snap-action start switch 38. The larger diameter of wheel 30 than the individual cams of cam stack 18 allows free pivoting of lever 36 without interference to the cam stack 18.

Figure 3:
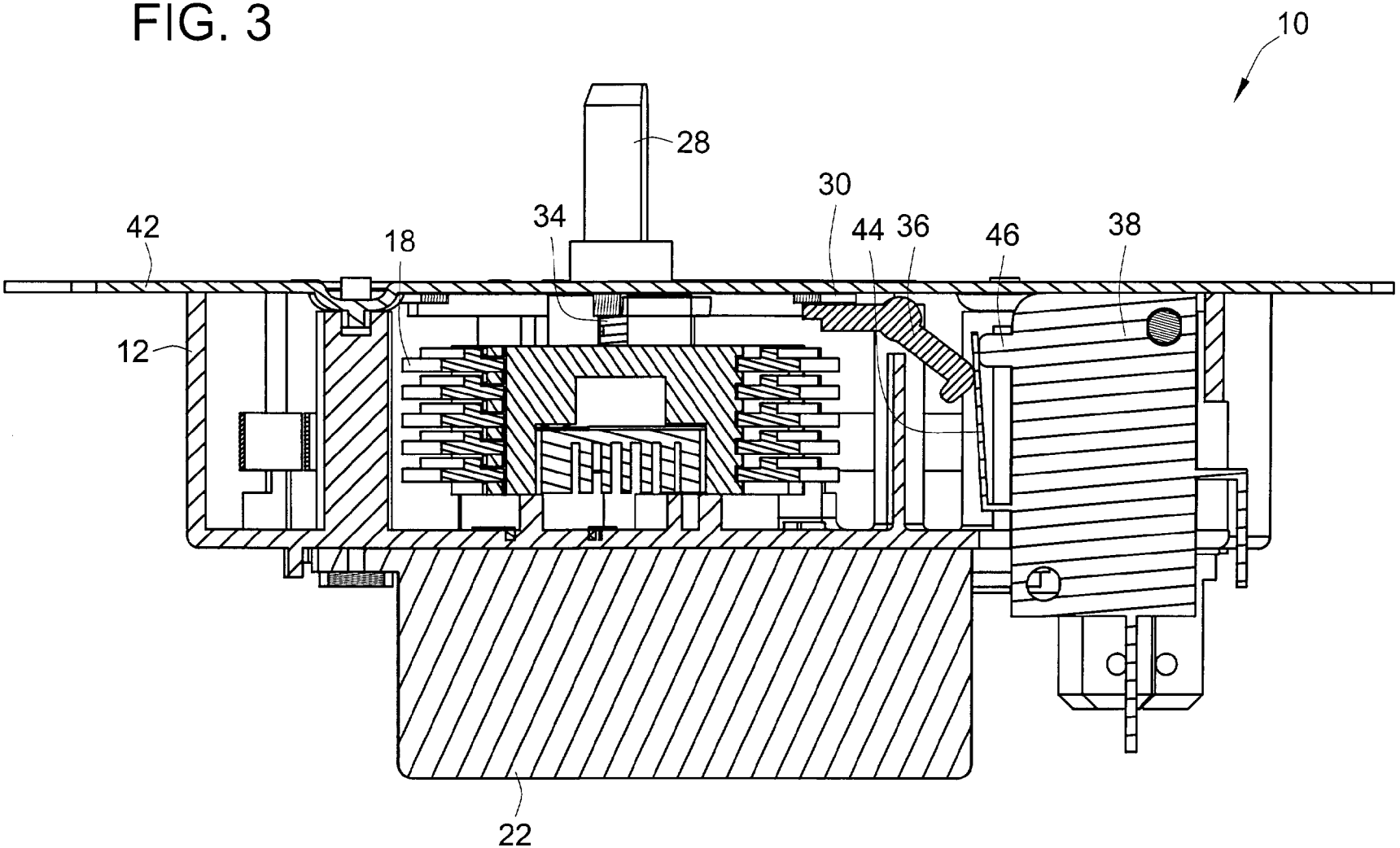
FIG. 3 is a simplified cross-sectional illustration of the program timer of FIG. 1 illustrated with its shaft in a quiescent position.
Figure 4:
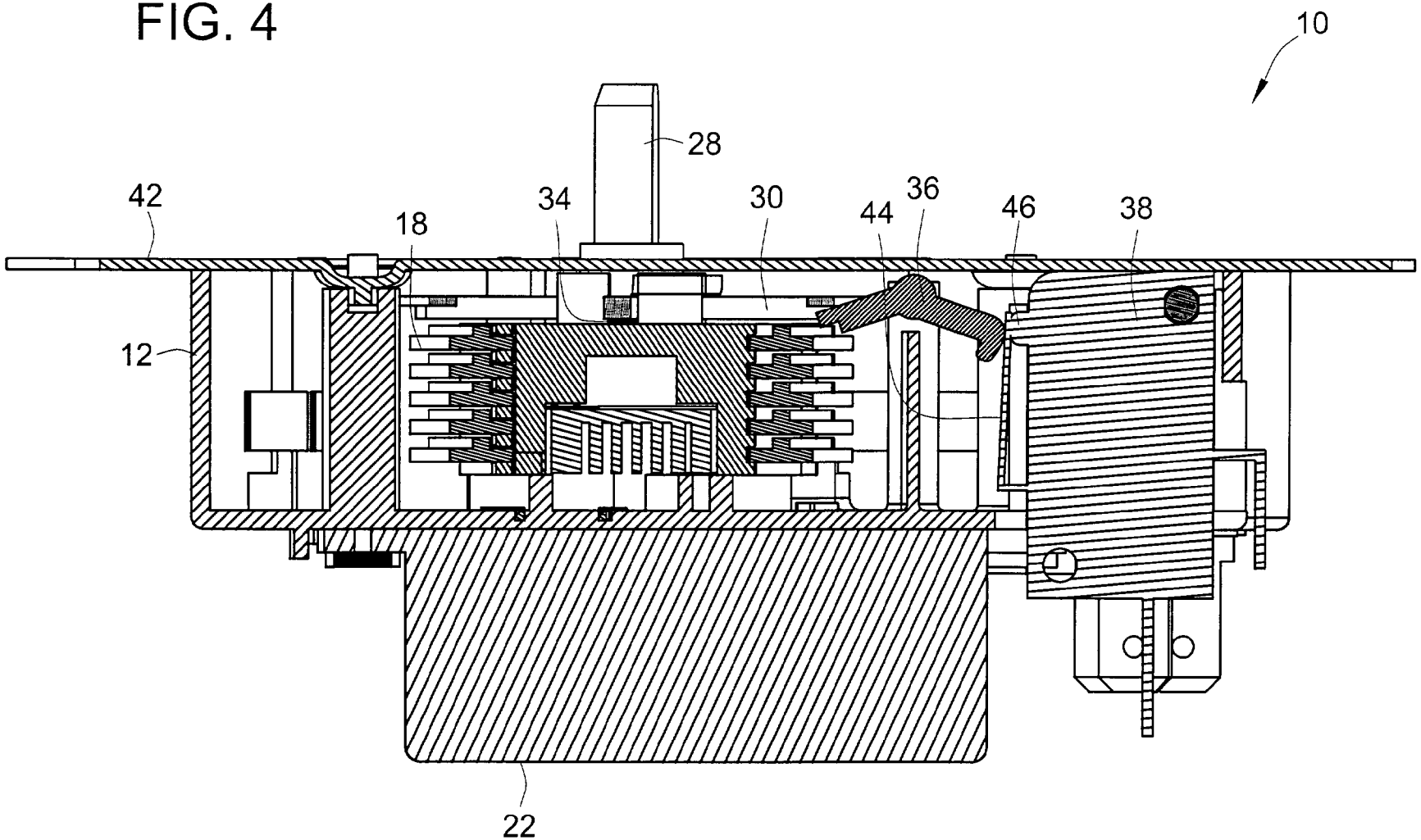
FIG. 4 is a simplified cross-sectional illustration similar to FIG. 3 illustrated with its shaft in an actuated depresses position.

Turning now to FIGS. 3 and 4, the operational relationship between wheel 30, lever 36, and snap-action start switch 38 will be described as the shaft 28 is linearly translated between its outwardmost quiescent position (shown in FIG. 3) and its inwardmost actuated position (shown in FIG. 4).

With specific attention to FIG. 3, the program timer of the present invention 10 is illustrated in its quiescent or normal program sequencing mode with the shaft 28 in its outward most position. This position is maintained by the return spring 34. As may be seen, the wheel 30 is also in its quiescent or outwardmost position. The snap-action switch 38 includes an activation mechanism comprised of an actuation surface 44 and an actuation push button 46. The typical internal mechanism of the push button switch 38 maintains the push button 46 in an outward position. The activation lever 36 is pivotally attached within the housing 12 such that it is in contact with the wheel 30 and the actuation surface 44. That is, return spring 34 maintains the shaft 28 and wheel 30 in their quiescent position, while the operation of the push button 46 and surface 44 maintain the lever 36 in its quiescent position. This is an effect of the outward bias of the pushbutton 46 by the snap-action switch 38. In this state, the motor 22 is free to rotate the cam stack 18, as is the user through shaft 28, without interference from the lever 36.

FIG. 4 illustrates the relationship between the elements of this embodiment of the program timer 10 of the present invention upon linear translation of shaft 28 to its inward, actuated position. Such linear actuation typically occurs as a result of the user depressing the knob (not shown) to perform the push-to-start function enabled by the present invention. Upon such linear actuation, the lever 36 is caused to pivot by the linear translation of wheel 30 under action of the user. This pivoting of lever 36 causes one end of this lever 36 to slide upon actuation surface 44, which results in the inward depression of the push button 46 of the snap-action switch 38. That is, the downward linear translation of the shaft 28 in the orientation of FIG. 4 results in an outward displacement of surface 44 and push button 46. This translation from linear motion in one direction to linear motion in a normal direction provides packaging efficiencies which allow the addition of the push-to-start functionality without the requirement that the overall package of the assembly be increased.

While the above describes the construction of one embodiment of the present invention, the following discussion of FIGS. 5–9 is concerned with the functionality and advantages provided by the use of the snap-action switch to provide the push-to-start functionality for a consumer or commercial appliance, e.g. a dryer.

Figure 5:
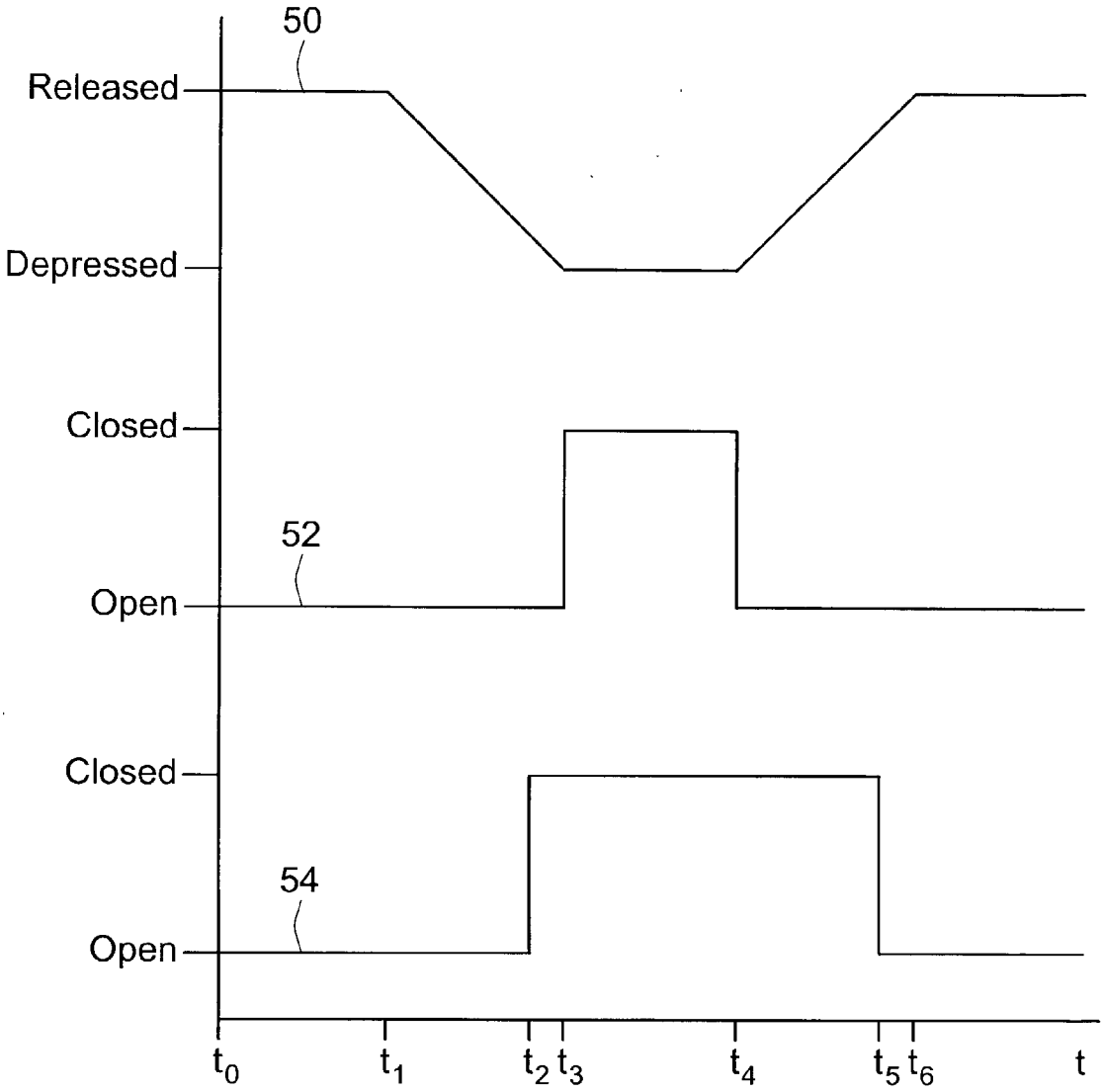
FIG. 5 is an idealized graphical illustration relating program timer shaft position to the start switch contact state for both conventional momentary contact push button switch contacts and the snap-action start switch contacts of the present invention.

FIG. 5 is a graphical illustration relating the position of the shaft 28 to the opening and closing of a conventional momentary contact push button switch as described in the background of the invention section above, and to the snap-action switch contact position for the snap-action switch 38 utilized in the program timer of the present invention. Initially, the shaft of the program timer is in its quiescent or released position as indicated at time $t_0$. At time $t_1$, however, the shaft 28 is slowly linearly actuated by a user from its released position to its fully actuated or depressed position, which is reached at time $t_3$. The shaft 28 is held in its fully depressed position until time $t_4$ at which point it is slowly allowed to return to its fully released or quiescent position at time $t_6$.

In conventional program timers that implement the push-to-start function, the contacts of the momentary contact push button switch remain open until the program timer shaft is fully depressed as indicated by trace 52 which transitions from an open to a closed position at time $t_3$. Similarly, the contacts of the conventional momentary contact push button switch are immediately opened upon initial withdrawal of the shaft as indicated by trace 52 at time $t_4$. That is, with a conventional program timer, the contacts of the start switch do not touch until the shaft is fully depressed, and no longer touch once the shaft begins to return to its quiescent state. There is no difference between the linear position of the shaft at which the contacts open and close.

Unlike the traditional push button momentary contact switch, the snap-action switch 38 of the present invention provides positional hysteresis for the opening and closing of its electrical contacts. This may be seen from trace 54 of FIG. 5. Specifically, as the shaft 28 is depressed beginning at time $t_1$, the lever 36 will begin to push on surface 44 (see FIG. 4) depressing push button 46 and supplying potential energy to the snap-action switch 38. At a time $t_2$, the amount of potential energy inputted to the snap-action switch 38 will be sufficient to operate the snap-action contacts resulting in their rapid closure at time $t_2$. The linear position at which such snap-action actuation occurs may be selected to be near the end of the linear travel of shaft 28, or indeed, at any point along this travel as desired. The positional hysteresis is illustrated as the shaft 28 is released beginning at time $t_4$. As illustrated by trace 54, the contacts of the snap-action switch 38 remain closed until a linear position is reached at time $t_5$ when, once again, enough potential energy has been stored within the snap-action switch 38 to actuate the snap-action mechanism to open the contacts. The linear position at which this snap-action actuation occurs may be varied as desired. In a preferred embodiment this actuation will occur near the fully released position of the shaft 28. However it may be selected to be anywhere along the linear position of the shaft 28 as desired.

By providing the positional hysteresis for actuation of the snap-action start switch 38, the starting function will only be performed upon deliberate depression of the shaft 28, and will remain in operation until deliberate release of the shaft 28. This opening and closing of the start switch contacts at two different linear positions of the shaft 28 will preclude the intermittent and switch life shortening operation as is common in conventional push-to-start switches where any hand jitter or palsy of the operator will result in multiple switch openings and closures.

The significant difference in operation between the conventional momentary contact push button switch and the snap-action start switch 38 of the present invention may be better understood through an analysis of the arcing and current flow between the contacts under both opening and closing conditions. With attention first to FIG. 6, there is illustrated an idealized graphical illustration of the shaft position 50 in the current flow between the contacts of the conventional momentary contact push button switch represented by trace 56. As may be seen, as the shaft of the program timer is linearly depressed beginning at time $t_1$, the contacts of the conventional momentary contact push button switch also linearly track this position so that they are coming in closer proximity as the shaft is depressed. At some point designated $t_a$ the contacts of the conventional switch will be close enough such that the electrical potential across the contacts will overcome the dielectric strength of the air in the switch, resulting in an electrical arc between these two contacts. This arc will continue and increase in current flow until the two contacts are fully closed as represented at time $t_3$. As is recognized by those skilled in the art, this arc will result in the accumulation of carbon and damage to the switch contacts themselves.

Figure 6:
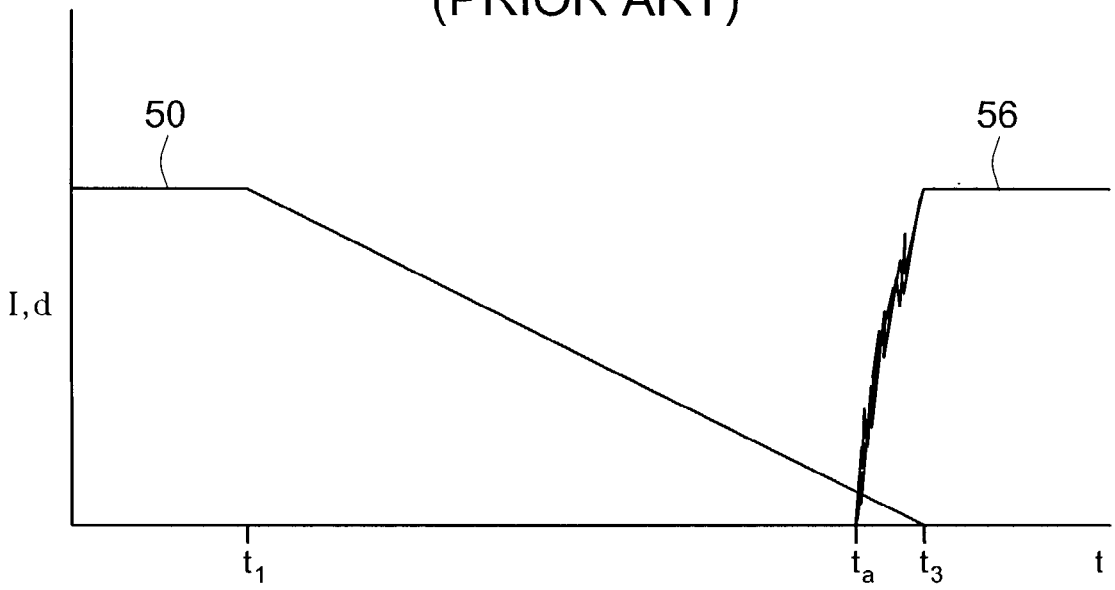
FIG. 6 (PRIOR ART)
FIG. 6 is an idealized graphical illustration relating current flow through a conventional push button start switch to the program timer shaft position as the shaft is depressed to its fully actuated position.
Figure 7:
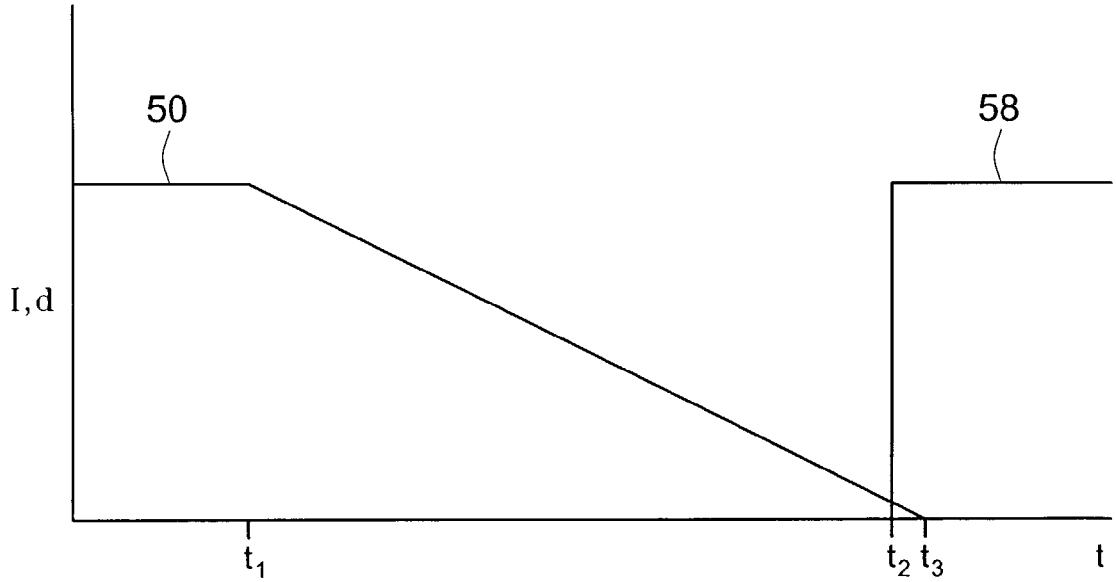
FIG. 7 is an idealized graphical illustration relating current flow through the snap-action start switch of the present intention to the program timer shaft position as the shaft is depressed to its fully actuated position.

In contrast to the operation of the conventional push button switch illustrated in FIG. 6, FIG. 7 illustrates the same linear translation of the shaft 28 of the program timer of the present invention and the resulting current flow between the contacts of the snap-action switch 38. The linear translation of the shaft illustrated by trace 50 has no effect on the physical spacing between the contacts of the snap-action switch 38. That is, operation of the snap-action switch described above initially results in the supplying of potential energy to the snap-action switch 38. Once a sufficient amount of potential energy is induced into the snap-action switch 38, its snap actuation occurs as illustrated at time $t_2$. As may be seen in this idealized FIG. 7, there is no significant pre-contact arcing between the contacts as is the case with the conventional switch. This is because the contacts are very rapidly transitioned between their fully opened and fully closed position as a result of the snap actuation of the switch 38. The storage of the potential energy and converting of that potential energy to a snap closure of these contacts precludes the sustaining of any arc during this closing operation.

Figure 8:
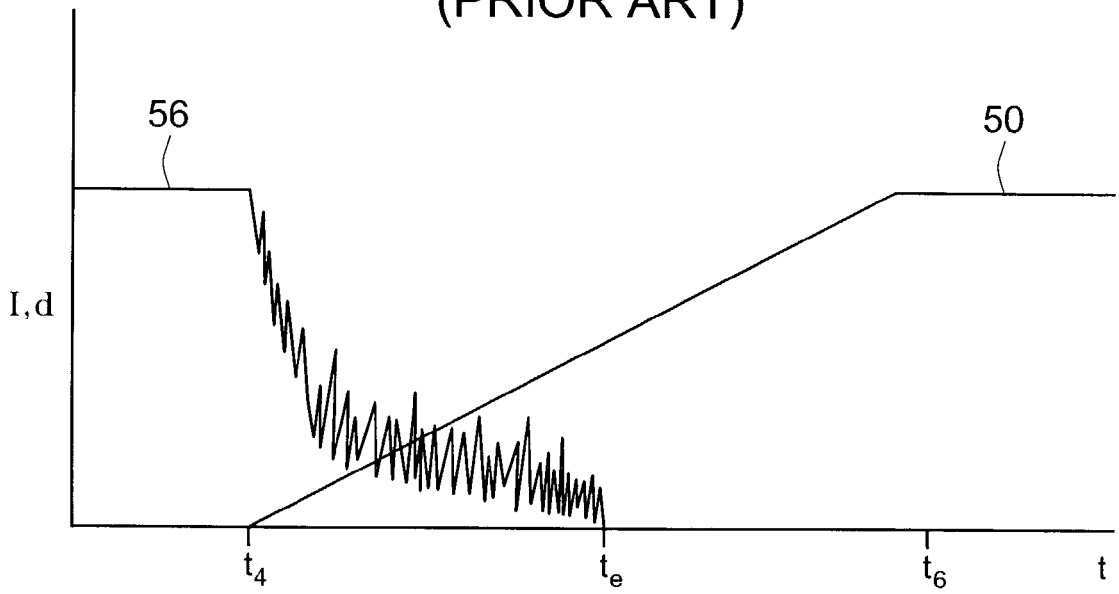
FIG. 8 (PRIOR ART)
FIG. 8 is an idealized graphical illustration relating current flow through a conventional push button start switch to the program timer shaft position as the shaft is returned to its quiescent position.

While the closing of the conventional push button switch can present an arcing problem if the user depresses the knob of the program timer very slowly, a more significant arcing problem occurs when the user releases or withdraws the knob of the program timer as illustrated in FIG. 8. As may be seen in this FIG. 8, the current flow between the contacts of the conventional push button switch illustrated as trace 56 is initially at its maximum while the contacts are closed. However, at time $t_4$ the user begins to release the knob of the program timer as illustrated by the increasing distance represented by trace 50. Since current is already flowing between the two contacts, the beginning of separation of these contacts draws a substantial arc which will be sustained, albeit diminishing in magnitude, until a time $t_e$. This time is significantly longer than the arc drawn upon closing, and results in a much greater accumulation of carbon and the significant potential for localized heating and melting of the metal of the contact surface. The amount of this type of damage is significantly increased the slower the user allows the knob to return to its quiescent position. Further, since there is no positional hysteresis of the opening and closing of the switch contacts, any teasing of the switch (i.e. maintaining the switch contacts in close physical proximity and occasionally allowing them to touch) results in significant damage to the switch contacts, greatly shortening the life and increasing the cost of ownership of the appliance.

Figure 9:
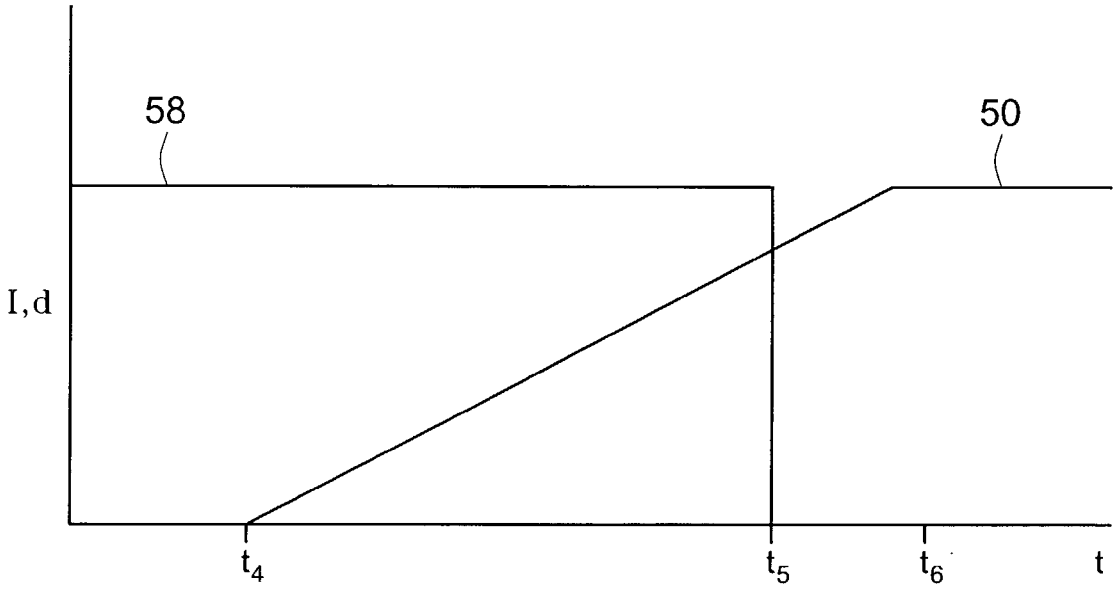
FIG. 9 is an idealized graphical illustration relating current flow through the snap-action start switch of the present invention to the program timer shaft position as the shaft is returned to its quiescent position.

In contrast to the use of the conventional push button switch, the use of the snap-action switch 38 in the program timer 10 of the present invention significantly reduces or eliminates the drawing of an arc upon opening of the switch as illustrated in FIG. 9. As discussed above, since the linear position of the switch relates only to the amount of potential energy supplied to the snap-action switch 38, and not to the physical proximity of the switch contacts themselves. The increasing linear position of the shaft represented by trace 50 does not affect the current flow 58 through the contacts of the snap-action switch until an amount of potential energy sufficient to result in actuation of the switch 38 is supplied. As illustrated in this FIG. 9, this point is reached at a time $t_5$ at which point the snap actuation of the contacts occurs to rapidly separate the two contacts. While an arc may well result between the contacts upon their opening, the speed at which the snap actuation occurs will minimize the potential for any contamination or damage to the switch contacts themselves. Indeed, the rapid separation of the switch contacts will completely or nearly remove any potential for melting of any portion of the switch contact material due to localized heating caused from a sustained electrical arc. As such, the use of the snap-action switch 38 provides significant advantages both in overall system operation and component lifetime.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A push-to-start appliance program timer for use with an appliance, comprising:

a housing;

a program cam stack defining at least one program cycle thereon;

a plurality of switches responsive to the at least one program cycle operable to control operation of the appliance during the program cycle;

a shaft in rotary driving engagement with the cam stack, the shaft being linearly translatable within the housing along an axis of the shaft through the cam stack, the shaft further having an actuation wheel integrated therewith;

a snap-action start switch;

an actuation lever positioned within the housing to translate linear movement of the shaft to actuate the snap-action switch; and wherein the wheel has an outer diameter larger than an outer diameter of the cam stack.

2. The timer of claim 1, further comprising a bias means for returning the shaft to a quiescent position within the housing.

3. The timer of claim 2, wherein the bias means comprises a spring positioned about the shaft to return the shaft to the quiescent position.

4. The timer of claim 1, wherein the shaft includes a user interface knob operably coupled on an end of the shaft external to the housing to rotate the shaft and the cam stack to select a program cycle, the wheel being operable to translate linear motion of the shaft to the lever at any rotary position of the knob.

5. A push-to-start appliance program timer for use with an appliance, comprising:

a housing;

a program cam stack defining at least one program cycle thereon;

a plurality of switches responsive to the at least one program cycle operable to control operation of the appliance during the program cycle;

a shaft in rotary driving engagement with the cam stack, the shaft being linearly translatable within the housing along an axis of the shaft through the cam stack, the shaft further having an actuation wheel integrated therewith;

a snap-action start switch;

an actuation lever positioned within the housing to translate linear movement of the shaft to actuate the snap-action switch; and wherein the snap-action start switch includes an actuation surface and a push button, and wherein the actuation lever translates the linear movement of the shaft to a normal direction by sliding along the actuation surface to actuate the push button.

6. A push-to-start appliance program timer for use with an appliance, comprising:

a housing;

a program cam stack defining at least one program cycle thereon;

a plurality of switches responsive to the at least one program cycle operable to control operation of the appliance during the program cycle;

a shaft in rotary driving engagement with the cam stack, the shaft being linearly translatable within the housing along an axis of the shaft through the cam stack, the shaft further having an actuation wheel integrated therewith;

a snap-action start switch;

an actuation lever positioned within the housing to translate linear movement of the shaft to actuate the snap-action switch;

a bias means for returning the shaft to a quiescent position within the housing; and wherein the snap-action start switch includes an outwardly biased push button operably coupled through an actuation surface to the actuation lever.

7. The timer of claim 3, wherein the snap-actuation start switch actuates to close electrical contacts therein upon linear translation of the shaft to a first position, and wherein the snap-actuation start switch actuates to open the electrical contacts therein upon linear translation of the shaft to a second position.

8. The timer of claim 7, wherein the first position and the second position are not equal.

9. The timer of claim 7, wherein the first position and the second position are selected to provide positional hysteresis for actuation of the snap-action start switch.

10. The timer of claim 7, wherein the first position is selected to be proximate to a maximum linear translation of the shaft, and wherein the second position is selected to be proximate to the quiescent position of the shaft.

11. An appliance program timer, comprising:

a shaft configured to accommodate a user interface knob affixed on an end thereof;

a program control mechanism responsive to a rotary position of the shaft to control operation of an appliance;

a snap-action start switch responsive to a linear translation of the shaft to a first position to close electrical contacts therein to begin a selected program cycle and to a second position to open the electrical contacts therein; and wherein the first position and the second position are selected to provide linear positional hysteresis for the actuation of the snap-action start switch.

12. The timer of claim 11, further comprising an activation lever pivotably positioned to translate linear motion in the shaft in a first direction to linear motion in a normal direction to activate the snap-action start switch.

13. The timer of claim 12, wherein the shaft includes an actuation wheel integrated therewith, and wherein linear motion in the shaft is translated to the activation lever by the activation wheel regardless of a rotary position of the shaft.

14. The timer of claim 11, further comprising a bias means for linearly biasing the shaft to a quiescent linear position.

15. The timer of claim 14, wherein the shaft is linearly translatable between the quiescent linear position and an inward depressed position, and wherein the first position is selected to be closer to the inward depressed position than the quiescent linear position, and wherein the second position is selected to be closer to the quiescent linear position than the inward depressed position.

16. The timer of claim 14, wherein the shaft is linearly translatable between the quiescent linear position and an inward depressed position, and wherein the first position is selected to be proximate to the inward depressed position, and wherein the second position is selected to be proximate to the quiescent linear position.

17. The timer of claim 14, wherein the bias means is a compression spring.

18. The timer of claim 11, wherein the program control mechanism is a motor driven cam stack having a plurality of program cycles programmed thereon, the mechanism further comprising a plurality of switches operating in response to the program cycles to control operation of the appliance.

19. A method of providing a push-to-start function in an appliance program timer having a shaft that is rotatable to select a desired program cycle and linearly translatable from an outward biased position to an inward depressed position to start the program cycle, comprising the steps of:

providing a snap-action start switch;

actuating the snap-action start switch to close electrical contacts therein upon linear translation of the shaft to a first position; and actuating the snap-action start switch to open the electric contacts therein upon linear translation of the shaft to a second position.

20. The method of claim 19, wherein the step of actuating the snap-action start switch to close the electrical contacts therein upon linear translation of the shaft to the first position comprises the step of actuating the snap-action start switch to close the electrical contacts therein upon linear translation of the shaft to a first position proximate the inward depressed position.

21. The method of claim 19, wherein the step of actuating the snap-action start switch to open the electrical contacts therein upon linear translation of the shaft to the second position comprises the step of actuating the snap-action start switch to open the electrical contacts therein upon linear translation of the shaft to a second position proximate the outward biased position.

* * * * *